US010095260B2

(12) United States Patent
Corbishley et al.

(10) Patent No.: US 10,095,260 B2
(45) Date of Patent: Oct. 9, 2018

(54) START-UP CIRCUIT ARRANGED TO INITIALIZE A CIRCUIT PORTION

(71) Applicant: Nordic Semiconductor ASA, Trondheim (NO)

(72) Inventors: Phil Corbishley, Trondheim (NO); Sebastian Ioan Ene, Trondheim (NO)

(73) Assignee: Nordic Semiconductor ASA, Trondheim (NO)

( * ) Notice: Subject to any disclaimer, the term of this patent is extended or adjusted under 35 U.S.C. 154(b) by 0 days.

(21) Appl. No.: 15/736,763

(22) PCT Filed: Jun. 16, 2016

(86) PCT No.: PCT/GB2016/051790
§ 371 (c)(1),
(2) Date: Dec. 14, 2017

(87) PCT Pub. No.: WO2016/203237
PCT Pub. Date: Dec. 22, 2016

(65) Prior Publication Data

US 2018/0188764 A1 Jul. 5, 2018

(30) Foreign Application Priority Data

Jun. 16, 2015 (GB) ..... 1510554.7

(51) Int. Cl.
*G05F 3/26* (2006.01)
*G05F 3/30* (2006.01)

(52) U.S. Cl.
CPC ..... *G05F 3/262* (2013.01); *G05F 3/30* (2013.01)

(58) Field of Classification Search
CPC ..... G05F 1/468; G05F 1/461; G05F 3/30
See application file for complete search history.

(56) References Cited

U.S. PATENT DOCUMENTS 4,956,618 A 9/1990 Ulmer
5,087,830 A * 2/1992 Cave ..... G05F 3/30 323/314

(Continued)

FOREIGN PATENT DOCUMENTS

GB 2430766 A 4/2007

OTHER PUBLICATIONS

International Search Report and Written Opinion for PCT/GB2016/051790, dated Sep. 26, 2016, 11 pages.

(Continued)

*Primary Examiner* — Yusef A Ahmed
(74) *Attorney, Agent, or Firm* — Klarquist Sparkman, LLP

(57) ABSTRACT

A start-up circuit arranged to initialize a circuit portion with a zero stable point and a non-zero stable point. The start-up circuit includes: a capacitive voltage divider including a first capacitor and a second capacitor that generate a divider bias voltage at a divider node; a differential amplifier including first and second amplifier inputs and an amplifier output connected to the divider node; a first driver transistor with its gate terminal connected to the divider node, and its drain terminal connected to a first start-up output and the first amplifier input; and a second driver transistor with its gate terminal connected to the divider node, and its drain terminal connected to a second start-up output and the second amplifier input. The differential amplifier controls the divider bias voltage and drives the circuit portion to the non-zero stable point.

12 Claims, 3 Drawing Sheets

(56) References Cited

U.S. PATENT DOCUMENTS

| | | | | |
|---|---|---|---|---|
| 6,133,719 | A | 10/2000 | Maulik | |
| 6,242,898 | B1 | 6/2001 | Shimizu et al. | |
| 7,148,672 | B1 | 12/2006 | Holmes | |
| 2004/0113709 | A1* | 6/2004 | Sibrai | H03B 5/364 331/182 |
| 2004/0124823 | A1 | 7/2004 | Fulton et al. | |
| 2004/0257150 | A1* | 12/2004 | Farooqui | G05F 3/30 327/539 |
| 2005/0218988 | A1* | 10/2005 | Berkhout | H03F 3/2171 330/269 |
| 2006/0091955 | A1* | 5/2006 | Choi | H03F 1/08 330/260 |
| 2006/0197584 | A1 | 9/2006 | Hsu | |
| 2007/0164722 | A1 | 7/2007 | Rao et al. | |
| 2007/0194770 | A1 | 8/2007 | Kalyanaraman | |
| 2007/0200616 | A1* | 8/2007 | Shin | G05F 3/30 327/539 |
| 2011/0006749 | A1* | 1/2011 | Stellberger | G05F 3/30 323/313 |
| 2015/0349734 | A1* | 12/2015 | Lee | H03F 3/45659 330/260 |

OTHER PUBLICATIONS

Search Report under Section 17(5) for GB1510554.7, dated Jan. 21, 2016, 3 pages.

* cited by examiner

START-UP CIRCUIT ARRANGED TO INITIALIZE A CIRCUIT PORTION

CROSS REFERENCE TO RELATED APPLICATIONS

This is the U.S. National Stage of International Application No. PCT/GB2016/051790, filed Jun. 16, 2016, which was published in English under PCT Article 21(2), which in turn claims the benefit of Great Britain Application No. 1510554.7, filed Jun. 16, 2015.

Start-up circuits are an essential building block for the construction of many integrated circuits, in particular circuits that have a number of possible stable states such as bandgap voltage reference circuits, oscillators, and flip-flops.

As an example, bandgap voltage reference circuits are used to provide a temperature-stable voltage reference. Such a bandgap reference circuit operates using a voltage difference between two transistors operated at different current densities to produce an output voltage with low temperature dependence. A silicon-based bandgap circuit will usually produce an output voltage of around 1.25 V, close to the voltage required for a charge carrier (i.e. an electron or a hole) to overcome the 1.22 eV bandgap associated with silicon at absolute zero.

There are two operating points at which the two transistors draw an identical drain current when the same gate-source voltage is applied to each. When operated at either of these points, the bandgap reference circuit is stable over a wide range of temperatures. The first is what is known as the "zero operating point", in which the voltage applied and the drain currents are all zero—a situation which is of little interest for producing a reference voltage. The "non-zero operating point" exists at a finite, non-zero voltage which when applied across the gate-source interface of the two transistors, causes the same current to flow through each transistor.

Such a bandgap reference is stable at each of these operating points and will converge towards one or the other whenever possible. It is clear therefore that while there are two possible operating points, only the normal operating point is of interest with a view to creating a stable, non-zero reference voltage. When such a bandgap reference circuit is powered on with no external voltages applied, more often than not it will tend to stabilise at the zero operating point. A start-up circuit is therefore used in order to give the bandgap reference circuit a "kick" (i.e. an "impulse" or a "transient event") in order to force it towards the non-zero operating point as required.

One conventional solution is to sense the zero operating point and inject a current into a transistor of the bandgap reference circuit. This can be used to force the bandgap reference circuit to a desired operating point with relative ease, but can lead to large currents on the output of the circuit which, if connected to external circuits, may cause damage. This start-up circuitry will also draw small amounts of current, which will cause an error in the output voltage. This is particularly an issue for smaller device fabrication sizes such as 16 nm and 28 nm.

When viewed from a first aspect, the present invention provides a start-up circuit arranged to initialise a circuit portion with a zero stable point and a non-zero stable point, the start-up circuit comprising:

a capacitive voltage divider including a first capacitor in series with a second capacitor that generates a divider bias voltage between said first and second capacitors at a divider node;

a differential amplifier including a first amplifier input, a second amplifier input, and an amplifier output connected to the divider node;

a first driver transistor arranged such that a gate terminal of the first driver transistor is connected to the divider node, and a drain terminal of the first driver transistor is connected to both a first start-up output and the first amplifier input; and a second driver transistor arranged such that a gate terminal of the second driver transistor is connected to the divider node, and a drain terminal of the second driver transistor is connected to both a second start-up output and the second amplifier input;

wherein the start-up circuit is arranged such that the differential amplifier controls the divider bias voltage and drives the circuit portion to the non-zero stable point.

Thus it will be seen by those skilled in the art that the present invention provides a start-up circuit that can be used to initialise a circuit portion such as a bandgap voltage reference circuit to a desired state. The capacitive voltage divider provides the initial kick to the system on power-up. Due to the voltage divider, a small divider bias voltage causes the driver transistors to open, allowing a small current to flow through each, which in turn increases the voltage applied to the amplifier inputs. The amplifier then permits a greater current to flow through itself, reducing the bias voltage (i.e. the amplifier pulls down the bias voltage), which causes the driver transistors to permit more current to flow therethrough. By initialising the circuit in this manner, the currents generated within the bandgap circuit are kept to a minimum. Should the currents from the bandgap reference circuit be mirrored for use in other external circuits, the risk of damaging said external circuits with excessive current is reduced.

The Applicant has appreciated that conventional start-up circuits often have a capacitor connected between the power supply or ground and the driver transistors for stability and so implementing the invention requires only one additional capacitor. Conventional start-up circuits use this capacitor to stabilise an amplifier within the start-up circuit. The second capacitor can be chosen to create the desired capacitance ratio as discussed later.

While there are a number of differential amplifier arrangements suited to the invention, in a set of embodiments the differential amplifier comprises a long tailed pair arrangement including first and second mirror transistors, and first and second differential pair transistors. In a set of embodiments, the mirror transistors are p-channel metal-oxide-semiconductor (PMOS) field-effect transistors. In a set of embodiments, the differential pair transistors are n-channel metal-oxide-semiconductor (NMOS) field-effect transistors. This choice of PMOS and NMOS transistors is particularly suitable for use between a positive supply rail and ground as conventional in integrated circuit design, but the invention could be implemented by reversing the transistor types and swapping the polarity of the voltage supply.

In a set of embodiments, the first and second mirror transistors are arranged such that their respective source terminals are connected to a supply voltage and their respective gate terminals are connected together. In a set of embodiments, the first mirror transistor is diode-connected (i.e. its drain terminal is connected to its gate terminal).

In a set of embodiments, the drain terminal of the first mirror transistor is connected to the drain terminal of the first differential pair transistor and the drain terminal of the second mirror transistor is connected to the drain terminal of the second differential pair transistor. This ensures that the same current flows through each "leg" of the differential amplifier.

In a set of embodiments, the source terminals of the first and second differential pair transistors are connected to each other. In a set of embodiments, the source terminals of the first and second differential pair transistors are connected to a current source. In a set of embodiments, the current source is a current mirror.

In a set of embodiments, the circuit comprises a current mirror output transistor arranged such that its gate terminal is connected to the divider node. In a set of embodiments, the drain terminal of the current mirror output transistor is connected to an external current mirror. This external current mirror provides an output current for external circuitry and mirrors the current flowing through the circuit portion.

An embodiment of the invention will now be described, by way of example only, with reference to the accompanying drawings in which.

Figure 1:
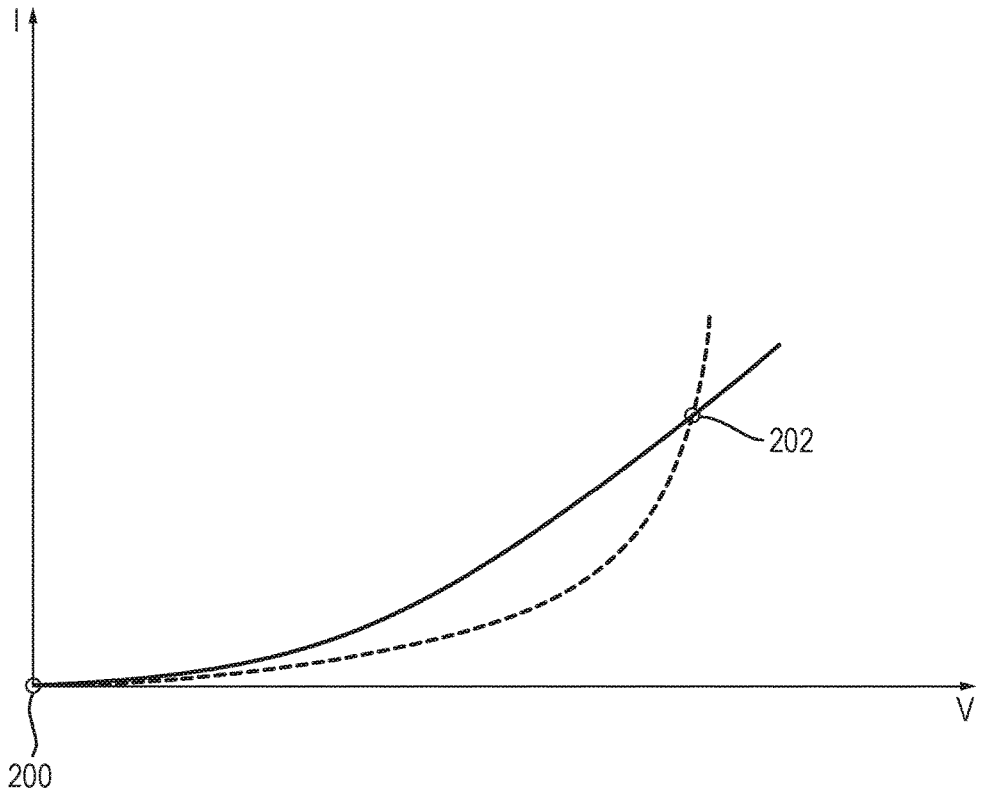
FIG. 1 shows the stable points of a typical bandgap reference voltage circuit.

FIG. 1 shows the stable points of a typical bandgap reference voltage circuit with two reference transistors. There are two points at which the current-voltage plots for each reference transistor meet, i.e. where for a given current density, the voltage across the transistors is the same. These are the desirable operating points where the reference voltage taken as the output has a flat temperature response.

There is a zero stable point 200 at the origin, which is of little practical interest as no currents flow at this point. There is also a non-zero stable point 202, at which the reference circuit functions as desired. The purpose of the start-up circuit described herein is therefore to drive the bandgap circuit to the non-zero operating stable point 202 rather than the zero one 200.

Figure 2:
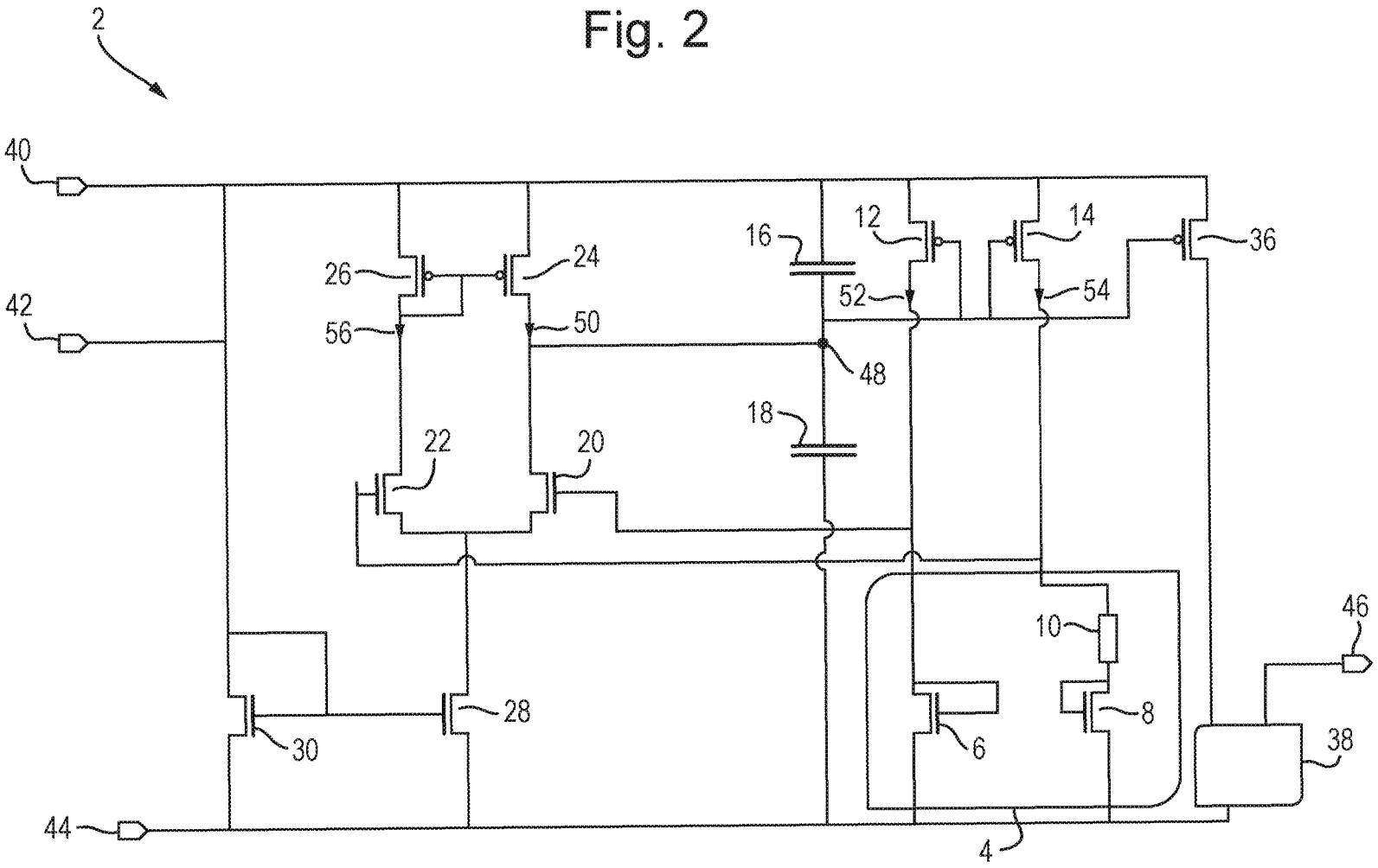
FIG. 2 is a circuit diagram of a start-up circuit in accordance with an embodiment of the invention.

FIG. 2 is a circuit diagram of a start-up circuit 2 in accordance with an embodiment of the invention. The start-up circuit is configured to initialise a bandgap reference circuit 4 with the stable points illustrated in FIG. 1. The bandgap reference circuit 4 comprises a pair of n-channel metal-oxide-semiconductor ("NMOS") field-effect transistors ("FET"s or "MOSFET" s) 6, 8—one transistor 8 of which is connected in series with a fixed resistor 10 via its drain terminal.

The two bandgap transistors 6, 8 are each driven by respective p-channel metal-oxide-semiconductor ("PMOS") field-effect transistors 12, 14. The PMOS driver transistors 12, 14 are arranged such that their source terminals are connected to the supply voltage 40. One of the driver transistors 12 has its drain terminal connected to the drain terminal of one of the bandgap transistors 6, while the drain terminal of the other driver transistor 14 is connected to the drain terminal of the other bandgap transistor 8 via the fixed resistor 10. Both bandgap transistors 6, 8 are diode-connected (i.e. their respective gate and drain terminals are connected to one another). For increased temperature sensitivity, the bandgap transistors 6, 8 may be implemented using NPN bipolar junction transistors (BJTs) instead of NMOSFETs.

The driver transistors 12, 14 and bandgap reference circuit 4 form two distinct "paths". The first is defined as the path from supply voltage 40 to ground 44 through driver transistor 12 and bandgap transistor 6, while the second is defined as the path from supply voltage 40 to ground 44 through driver transistor 14, fixed resistor 10 and bandgap transistor 8.

The drain terminals of the driver transistors 12, 14 are each connected to the respective gate terminals of NMOS differential pair transistors 20, 22. Along with two PMOS current mirror transistors 24, 26, these differential pair transistors 20, 22 form a single-sided differential amplifier.

The PMOS current mirror transistors 24, 26 are arranged such that their source terminals are connected to the supply voltage 40, while their drain terminals are each connected to the respective drain terminals of the differential pair transistors 20, 22. The gate terminals of the current mirror transistors 24, 26 are connected to one another, and the drain and gate terminals of one current mirror transistor 26 are connected in order to place it in a diode-connected configuration.

A capacitive voltage divider is formed by two capacitors 16, 18 which are connected between the positive supply rail 40 and ground 44. This arrangement leads to a non-zero voltage located at the node 48 between the two capacitors.

The drain terminals of one of the current mirror transistors 24 and its associated differential pair transistor 20 are connected directly to the node 48 between the two capacitors 16, 18. The node 48 is further connected to the gate terminals of the two divider transistors and of a PMOS output current mirror transistor 36, which feeds current to a current mirror 38, which in turn produces an output current 46.

The source terminals of the differential pair transistors 20, 22 are both connected to an NMOS current source transistor 28, which acts as a current source for the differential amplifier. It is arranged to mirror the current passing through an NMOS transistor 30, which itself is connected to an input current 42.

A voltage difference between the two transistors 6, 8 when operated at different current densities due to the fixed resistor 10 is used as a reference voltage by external circuits. The bandgap circuit 4 is stable when operated at a point at which the two transistors 6, 8 draw an identical drain current when the same gate-source voltage is applied to each.

Figure 3:
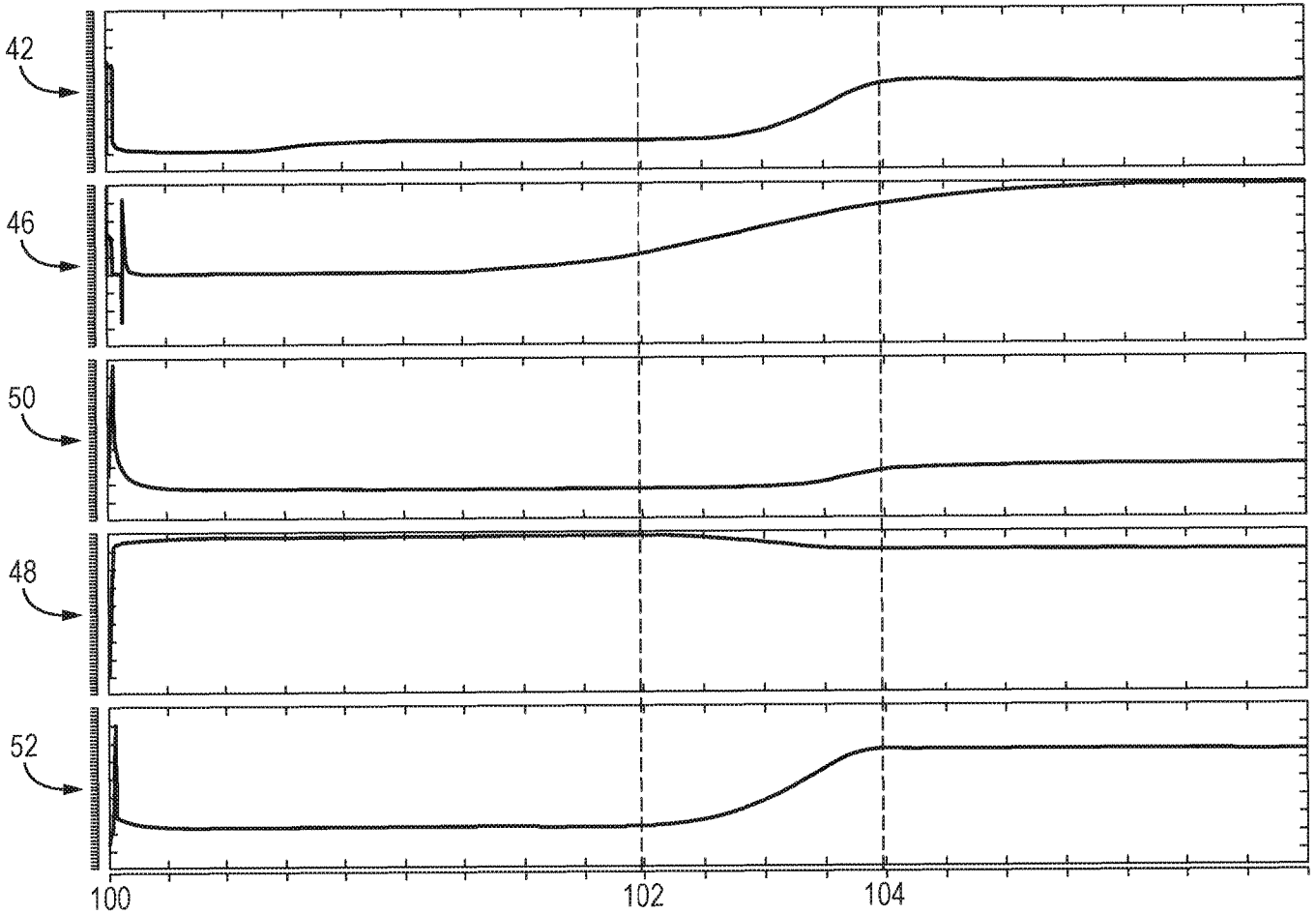
FIG. 3 is a timing diagram showing the typical operation of the start-up circuit of FIG. 2.

FIG. 3 is a timing diagram showing the typical operation of the start-up circuit 2 of FIG. 2.

When the circuit 2 is switched on at initial time 100, there is a time-varying component on the supply voltage 40 and thus the input current 42 due to the transient response of the circuit. While the capacitors 16, 18 are effectively open circuit to DC (i.e. non-time-varying) signals, they provide charge injection due to the resulting time-varying voltage. The voltage at the node 48 is determined—at least initially when the transistors connected thereto are "off"—by the magnitude of the time-varying voltage present on the supply rail, multiplied by the ratio of the capacitance of capacitor 16 to the total capacitance of both capacitors 16, 18 combined. Since the voltage at the node 48 is necessarily smaller than the supply voltage 40, there is a negative gate-source voltage applied across the two driver transistors 12, 14. This causes each of the driver transistors 12, 14 to switch "on" and conduct a small current 52, 54 respectively (only the current 52 through driver transistor 12 is shown for illustrative purposes).

As the driver transistors 12, 14 conduct more current, their drain terminals are driven to increasingly higher voltages, which drives the voltage applied at the gate terminals of the differential pair transistors 20, 22 to higher voltages accordingly. This increases the gate-source voltage of each of the differential pair transistors 20, 22, causing them to switch on and also begin conducting current 50, 56.

At time 102, once sufficient current 50 begins flowing through the differential pair transistor 20, the voltage at node 48 is pulled down accordingly.

Since the voltage at the node 48 is then reduced, the driver transistors 12, 14 have a yet higher negative gate-source voltage applied to them, and thus conduct yet more current.

This cyclical arrangement drives the bandgap reference circuit 4 away from its zero operating point 200 and towards its non-zero operating point 202 (see FIG. 1). Eventually at time 104, the current through each of these paths will reach an equilibrium point wherein the voltages applied to the gates of the differential pair transistors 20, 22 is equal, and the node 48 remains stable at the resulting differential voltage. At this stage, the bandgap circuit 4 has been initialised to its non-zero operating point and the start-up circuit is now effectively "switched off" (in practice, drawing a minimal amount of current).

Throughout the operation of the circuit, the output current 46 remains within reasonable levels, with the initial spike at time 100 being substantially the same magnitude as its value during normal operation from time 104 onwards.

Thus it will be seen that a start-up circuit with a controlled output current has been described herein. Although a particular embodiment has been described in detail, it will be appreciated by those skilled in the art that many variations and modifications are possible using the principles of the invention set out herein.

The invention claimed is:

1. A start-up circuit arranged to initialize a circuit portion with a zero stable point and a non-zero stable point, the start-up circuit comprising:

a capacitive voltage divider including a first capacitor in series with a second capacitor that generates a divider bias voltage between said first and second capacitors at a divider node;

a differential amplifier including a first amplifier input, a second amplifier input, and an amplifier output connected to the divider node;

a first driver transistor arranged such that a gate terminal of the first driver transistor is connected to the divider node, and a drain terminal of the first driver transistor is connected to both a first start-up output and the first amplifier input; and a second driver transistor arranged such that a gate terminal of the second driver transistor is connected to the divider node, and a drain terminal of the second driver transistor is connected to both a second start-up output and the second amplifier input;

wherein the start-up circuit is arranged such that the differential amplifier controls the divider bias voltage and drives the circuit portion to the non-zero stable point.

2. The start-up circuit as claimed in claim 1, wherein the differential amplifier comprises a long tailed pair arrangement including first and second mirror transistors, and first and second differential pair transistors.

3. The start-up circuit as claimed in claim 2, wherein the first and second mirror transistors are p-channel metal-oxide-semiconductor (PMOS) field-effect transistors.

4. The start-up circuit as claimed in claim 2, wherein the first and second differential pair transistors are n-channel metal-oxide-semiconductor (NMOS) field-effect transistors.

5. The start-up circuit as claimed in claim 2, wherein the first and second mirror transistors are arranged such that their respective source terminals are connected to a supply voltage and their respective gate terminals are connected together.

6. The start-up circuit as claimed in-claim 2, wherein the first mirror transistor is diode-connected.

7. The start-up circuit as claimed in-claim 2, wherein a drain terminal of the first mirror transistor is connected to a drain terminal of the first differential pair transistor and a drain terminal of the second mirror transistor is connected to a drain terminal of the second differential pair transistor.

8. The start-up circuit as claimed in claim 2, wherein source terminals of the first and second differential pair transistors are connected to each other.

9. The start-up circuit as claimed in-claim 2, wherein source terminals of the first and second differential pair transistors are connected to a current source.

10. The start-up circuit as claimed in claim 9, wherein the current source is a current mirror.

11. The start-up circuit as claimed in-claim 1, wherein the start-up circuit comprises a current mirror output transistor arranged such that its gate terminal is connected to the divider node.

12. The start-up circuit as claimed in claim 11, wherein a drain terminal of the current mirror output transistor is connected to an external current mirror.

* * * * *